US008662661B2

(12) United States Patent
Yamamoto

(10) Patent No.: US 8,662,661 B2
(45) Date of Patent: Mar. 4, 2014

(54) LIQUID EJECTION APPARATUS HAVING FIRST CASING AND SECOND CASING ROTATABLE RELATIVE TO FIRST CASING

(71) Applicant: Brother Kogyo Kabushiki Kaisha, Nagoya (JP)

(72) Inventor: Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/629,534

(22) Filed: Sep. 27, 2012

(65) Prior Publication Data

US 2013/0106969 A1 May 2, 2013

(30) Foreign Application Priority Data

Oct. 31, 2011 (JP) ..... 2011-238858

(51) Int. Cl.
*B41J 29/13* (2006.01)

(52) U.S. Cl.
USPC ..... 347/108

(58) Field of Classification Search
USPC ..... 347/85, 101, 102, 104, 108, 222, 263
See application file for complete search history.

(56) References Cited

U.S. PATENT DOCUMENTS

| | | | | |
|---|---|---|---|---|
| 590,926 | A * | 9/1897 | Wheaton | 37/354 |
| 4,893,137 | A * | 1/1990 | Ebinuma et al. | 346/134 |
| 6,443,645 | B1 * | 9/2002 | Takei et al. | 400/621 |
| 8,220,797 | B2 * | 7/2012 | Yamamoto et al. | 271/302 |
| 8,240,660 | B2 * | 8/2012 | Yamamoto | 271/189 |
| 8,251,507 | B2 * | 8/2012 | Sugimoto et al. | 347/108 |
| 2006/0283695 | A1 * | 12/2006 | Deshimaru | 200/293 |
| 2009/0141111 | A1 * | 6/2009 | Yamamoto | 347/104 |
| 2009/0189966 | A1 * | 7/2009 | Sugimoto et al. | 347/104 |
| 2009/0200735 | A1 * | 8/2009 | Yamamoto | 271/264 |
| 2010/0078877 | A1 * | 4/2010 | Yamamoto et al. | 271/207 |
| 2010/0079528 | A1 * | 4/2010 | Yamamoto | 347/16 |
| 2011/0242180 | A1 * | 10/2011 | Yamamoto | 347/16 |
| 2012/0251166 | A1 * | 10/2012 | Yamamoto et al. | 399/110 |
| 2012/0300005 | A1 * | 11/2012 | Sugimoto et al. | 347/104 |
| 2013/0027490 | A1 * | 1/2013 | Sugimoto et al. | 347/104 |
| 2013/0050334 | A1 * | 2/2013 | Tsuboi et al. | 347/32 |
| 2013/0106965 | A1 * | 5/2013 | Yamamoto | 347/86 |

FOREIGN PATENT DOCUMENTS

JP 2005-081546 A 3/2005

OTHER PUBLICATIONS

Computer-generated translation of JP 2005-081546, published on Mar. 2005.*

* cited by examiner

*Primary Examiner* — Huan Tran
(74) *Attorney, Agent, or Firm* — Baker Botts L.L.P.

(57) ABSTRACT

In a liquid ejection apparatus, a second casing is connected to a first casing so as to be rotatable relative to the first casing about a prescribed axis. The second casing holds a liquid ejection head and a cartridge holding portion. A lower wall of the cartridge holding portion extends in an insertion direction, along which the cartridge holding portion enables a liquid cartridge to move when the liquid cartridge is inserted into the cartridge holding portion, the insertion direction being directed from a central point in an insertion opening in a direction perpendicular to an ejection surface toward a point that is on a reference imaginary plane, on which the axis extends and which is perpendicular to the ejection surface, and that is closer to the axis than upper and lower reference points.

9 Claims, 9 Drawing Sheets

LIQUID EJECTION APPARATUS HAVING FIRST CASING AND SECOND CASING ROTATABLE RELATIVE TO FIRST CASING

CROSS REFERENCE TO RELATED APPLICATION

This application claims priority from Japanese Patent Application No. 2011-238858 filed Oct. 31, 2011. The entire content of this priority application is incorporated herein by reference.

TECHNICAL FIELD

The present invention relates to a liquid ejection apparatus having a liquid ejection head for ejecting liquid from ejection openings.

BACKGROUND

There is known an ink jet printer whose recording unit has an upper casing and a lower casing. Recording heads and subsidiary tanks are fixedly mounted in the upper casing. The recording heads record images on sheets of paper by ejecting ink onto the sheets. The subsidiary tanks supply ink to the recording heads. Main tanks are mounted in the lower casing.

The upper casing is rotatable relative to the lower casing about a rotational shaft that is arranged in the rear side of the recording unit. The front surface of the recording unit is divided into two parts by rotating the upper casing upwardly to separate the front side of the upper casing away from the front side of the lower easing.

SUMMARY

It is an object of the present invention to provide an improved liquid ejection apparatus that has a first casing and a second casing rotatable relative to the first casing around a rotational shaft.

In order to attain the above and other objects, the present invention provides a liquid ejection apparatus including: a supporting portion; a liquid ejection head; a first casing; and a second casing. The supporting portion is configured to support a recording medium. The liquid ejection head has an ejection surface formed with ejection openings, through which the liquid ejection head ejects liquid, the liquid ejection head being configured to record an image on a recording medium supported by the supporting portion by ejecting liquid from the ejection openings. The first casing holds the supporting portion. The second casing holds the liquid ejection head and a cartridge holding portion, the cartridge holding portion being configured to hold a liquid cartridge, the liquid cartridge being detachably mountable in the cartridge holding portion, the cartridge holding portion having an upper wall and a lower wall opposite to the upper wall. The second casing is connected to the first casing so as to be rotatable relative to the first casing about a prescribed axis, the second casing being configured to move between a first position and a second position by rotating relative to the first casing, the liquid ejection head being located adjacent to the first casing when the second casing is in the first position, the liquid ejection head being further apart from the first casing when the second casing is in the second position than when the second casing is in the first position. The ejection surface opposes the supporting portion when the second casing is in the first position. The first direction is defined as being perpendicular to a direction of the axis and being parallel with the ejection surface of the liquid ejection head. The second casing has first and second external surfaces opposing each other, the first and second external surfaces extending in a direction intersecting with the ejection surface and in an axial direction in which the axis extends, the first external surface being further away from the axis in the first direction than the second external surface. The first external surface has an insertion opening through which a liquid cartridge is inserted into the cartridge holding portion, the insertion opening being defined by an upper edge and a lower edge, the upper edge being an intersection between the first external surface and the upper wall of the cartridge holding portion, the lower edge being an intersection between the first external surface and the lower wall of the cartridge holding portion. A reference imaginary plane is defined as an imaginary plane on which the axis extends and which is perpendicular to the ejection surface. When seen in the axial direction, a central point is defined as a central point in the insertion opening in a direction perpendicular to the ejection surface, a distance between the central point and the upper edge of the insertion opening in the direction perpendicular to the ejection surface being equal to a distance between the central point and the lower edge of the insertion opening in the direction perpendicular to the ejection surface, an imaginary line is defined as an imaginary line that passes through the central point and extends parallel with the first direction, an upper reference point is defined as an intersection point where the imaginary line intersects with the reference imaginary plane, a lower reference point is defined as a point that is on the reference imaginary plane and that is symmetrical with the upper reference point with reference to the axis, and the lower wall of the cartridge holding portion extends in an insertion direction, along which the cartridge holding portion enables the liquid cartridge to move when the liquid cartridge is inserted into the cartridge holding portion, the insertion direction being directed from the central point toward a point that is on the reference imaginary plane and that is closer to the axis than the upper and lower reference points.

BRIEF DESCRIPTION OF THE DRAWINGS

The particular features and advantages of the invention as well as other objects will become apparent from the following description taken in connection with the accompanying drawings, in which:

FIGS. 5A-5C illustrate how a lock mechanism operates, wherein FIG. 5A shows the state where the lock mechanism is in a restriction position when the upper casing is in a proximity position, FIG. 5B shows the state where the lock mechanism is in a release position when the upper casing is in the proximity position, and FIG. 5C shows the state where the lock mechanism is in the restriction position when the upper casing is in a separation position;

FIGS. 6A-6C illustrate how the lock mechanism and an interlocking mechanism operate, wherein FIG. 6A shows the state where a moving portion in the interlocking mechanism is in an engagement position and the lock mechanism is in the restriction position, FIG. 6B shows the state where the moving portion switches into a non-engagement position, but the lock mechanism has not yet reached the release position, and FIG. 6C shows the state where the moving portion is in the non-engagement position and the lock mechanism finally reaches the release position;

DETAILED DESCRIPTION

An ink-jet printer according to one embodiment of the present invention will be described with reference to the accompanying drawings.

Figure 1:
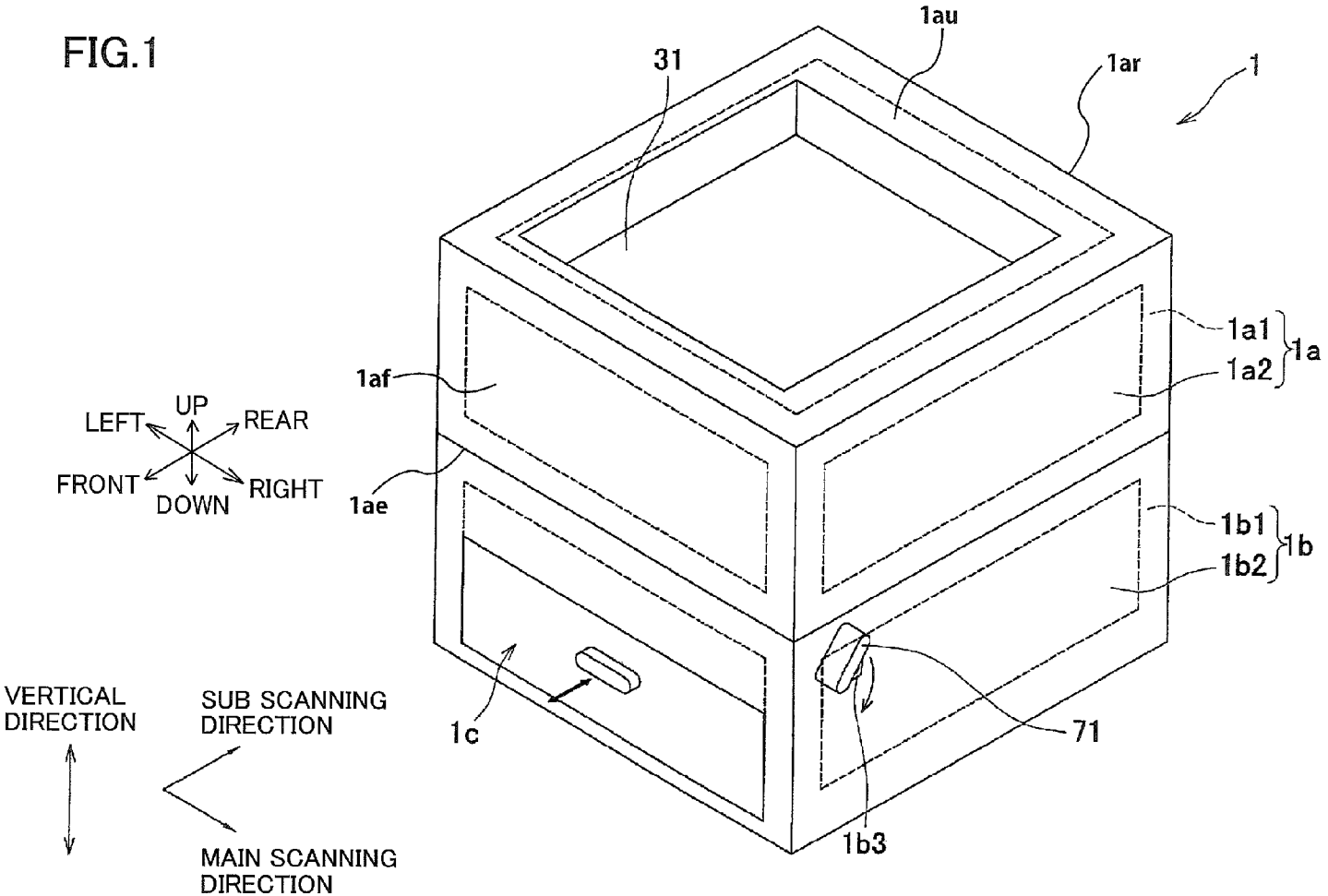
FIG. 1 is a perspective view showing an external appearance of an ink-jet printer according to an embodiment of the present invention.

First will be described the overall configuration of the ink-jet printer 1 with reference to FIGS. 1 to 3. The terms "upward", "downward", "upper", "lower", "above", "below", "beneath", "right", "left", "front", "rear" and the like will be used throughout the description assuming that the ink-jet printer 1 is disposed in an orientation in which it is intended to be used. In use, the ink-jet printer 1 is disposed as shown in FIG. 1, in which a main scanning direction of the ink jet printer 1 is parallel with the left-right direction, and a sub-scanning direction (or a direction perpendicular to the main scanning direction and the vertical direction) is parallel with the front-rear direction. The directions are defined also for a cartridge 50 (which will be described later) so that the directions of the cartridge 50 are defined for when the cartridge 50 is mounted in the ink-jet printer 1.

The printer 1 includes an upper casing 1*a* and a lower casing 1*b*. The upper casing 1*a* and the lower casing 1*b* both are in the shape of a rectangular parallelepiped and substantially equal in size. A lower surface of the upper casing 1*a* is opened. An upper surface of the lower casing 1*b* is opened. The upper casing 1*a* is stacked on the lower casing 1*b*, thereby sealing the opening surfaces of both. As a result, a space inside the printer 1 is defined (See FIG. 2).

The upper casing 1*a* includes: an upper-casing frame 1*a*1 forming a skeleton of the upper casing 1*a*; and an upper-casing decorative cover 1*a*2 covering the outside of the upper-casing frame 1*a*1. The lower casing 1*b* includes a lower-casing frame 1*b*1 forming a skeleton of the lower casing 1*b*; and a lower-casing decorative cover 1*b*2 covering the outside of the lower-casing frame 1*b*1.

A sheet discharging portion 31 is provided on an upper surface 1*au* of the upper casing 1*a*. It is noted that the upper surface 1*au* is defined by a top panel constituting the upper-casing decorative cover 1*a*2.

Figure 2:
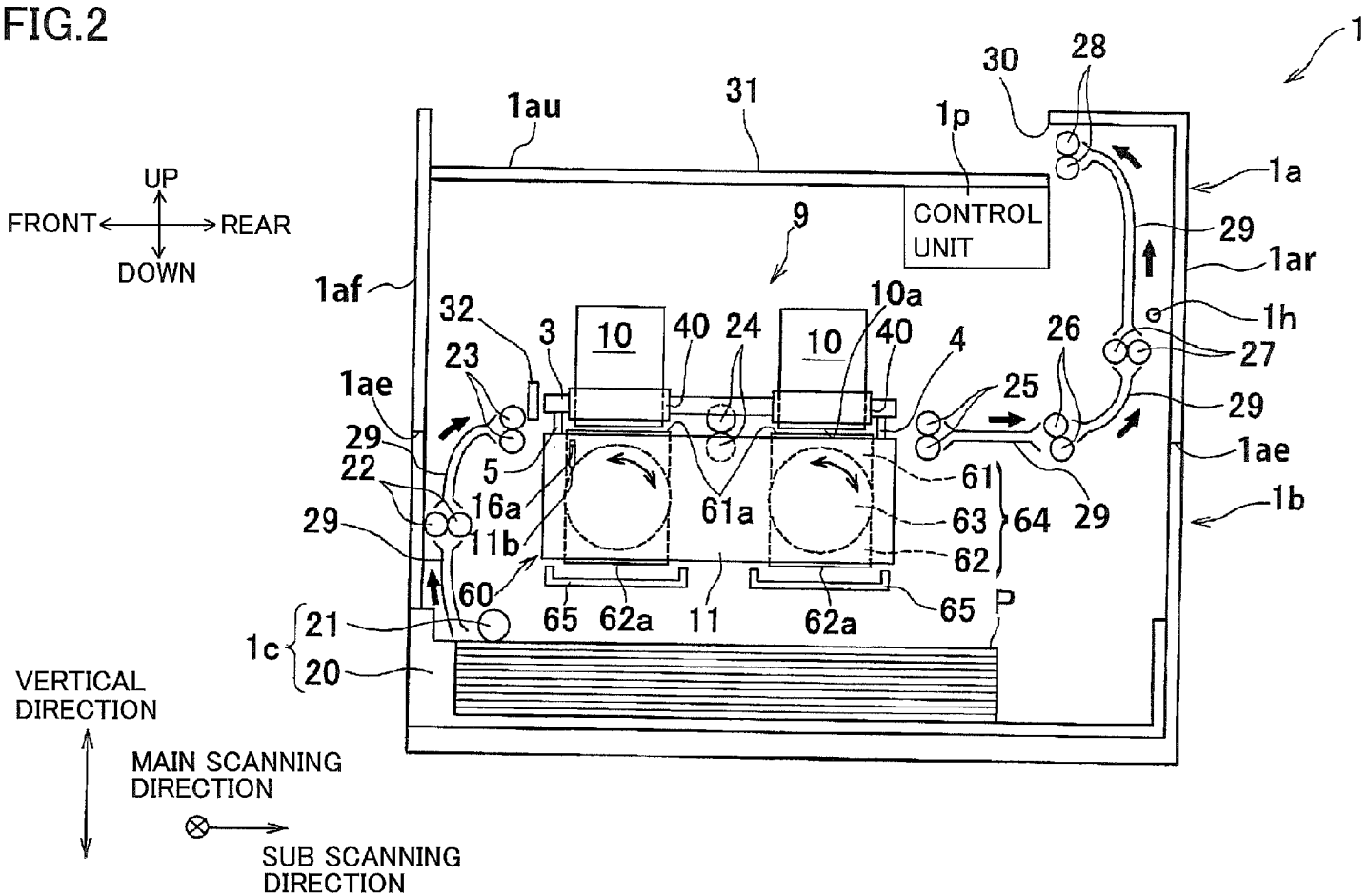
FIG. 2 is a side view schematically showing the internal configuration of the printer.

In the internal space of the printer 1, as indicated by bold arrows in FIG. 2, a conveying path is formed to convey a paper sheet P from a sheet supply portion 1*c* to the sheet discharging portion 31.

Figure 3:
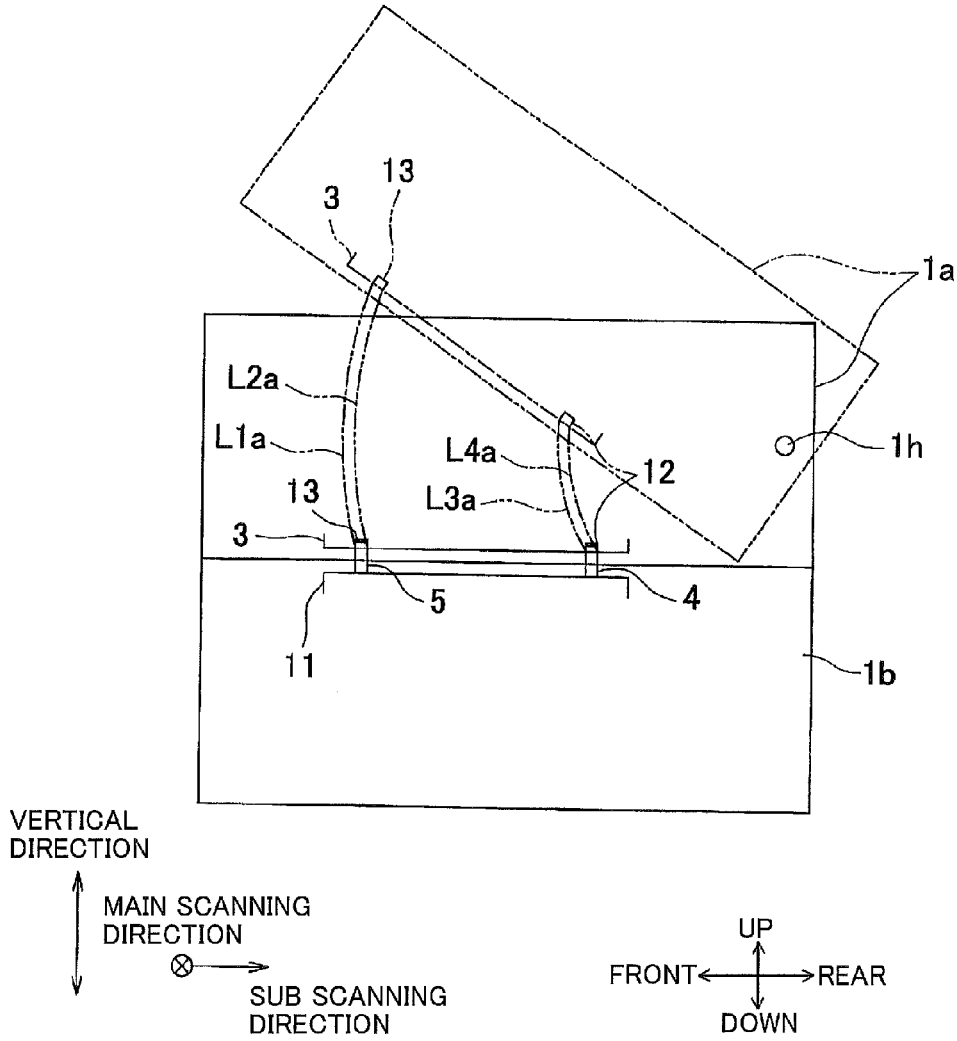
FIG. 3 illustrates the state how an upper casing is rotated relative to a lower casing.

As shown in FIGS. 2 and 3, the upper casing 1*a* is connected to the lower casing 1*b* through a shaft 1*h*. The shaft 1*h* extends in the main scanning direction. The shaft 1*h* is positioned on a rear side end portion of the upper casing 1*a* in the front-rear direction and substantially at a center of the upper casing 1*a* in the vertical direction. Thus, the shaft 1*h* is positioned closer to a rear surface 1*ar* of the upper casing 1*a* than to a front surface 1*af* of the upper casing in the front-rear direction. It is noted that the rear surface 1*ar* is defined by a rear panel in the upper-casing decorative cover 1*a*2, while the front surface 1*af* is defined by a front panel in the upper-casing decorative cover 1*a*2.

The upper casing 1 a is rotatable about an axis o (FIG. 7) of the shaft 1*h* relative to the lower casing 1*b*. The upper casing 1*a* can rotate between a proximity position (shown in FIG. 2 and indicated by solid lines in FIG. 3), in which the upper casing 1*a* is adjacent to the lower casing 1*b*, and a separation position (indicated by two-dot chain lines in FIG. 3), in which the upper casing 1*a* is farther away from the lower casing 1*b* than when the upper casing 1*a* is in the proximity position.

When the upper casing 1*a* is in the proximity position, liquid ejection surfaces 10*a* of heads 10 (to be described later) extend along the horizontal plane and oppose a supporting unit 60 (to be described later) in the vertical direction. When the upper casing 1*a* is in the separation position, part of the paper sheet conveying path is exposed to outside, thereby securing a working space for a user on the paper sheet conveying path formed inside the upper and lower casings 1*a* and 1*b*. Using the working space, the user can manually carry out a jam operation (or an operation of removing a paper sheet P jammed on the conveying path) and a maintenance operation of a recording unit 9 to be described later and the supporting unit 60. The maintenance operation is for removing unwanted matter from the liquid ejection surfaces 10*a* and supporting surfaces 61*a* and opposing surfaces 62*a* in the supporting unit 60 to be described later. Springs (not shown) are provided on the shaft 1*h* to urge the upper casing 1*a* in a direction to rotate the upper casing 1*a* from the proximity position toward the separation position, that is, to open the upper casing 1*a*. According to the present embodiment, the upper casing 1*a* can open until the upper casing 1*a* reaches a predetermined angle (about 35 degrees) relative to the horizontal plane.

As shown in FIG. 1, an opening 1*b*3 is formed on a right side surface of the lower-casing decorative lower-casing decorative cover 1*b*2. An operation portion 71 of a lock mechanism 70 is exposed through the opening 1*b*3. The lock mechanism 70 is for restricting the rotation of the upper casing 1*a* when the upper casing 1*a* is in the proximity position. The configuration of the lock mechanism 70 will be described later in detail.

As shown in FIG. 2, inside of the printer 1 there are provided: the sheet supply portion 1*c*; five pairs of guide walls 29; pairs of feed rollers 22, 23, 24, 25, 26, 27, and 28; a paper sheet sensor 32; the supporting unit 60; a wiper unit (not shown);

two waste liquid trays 65; the recording unit 9 including a frame 3 and two heads 10; a cartridge holding portion 51 and a cartridge 50 detachably mountable in the cartridge holding portion 51 (See FIGS. 7 and 8); and a control unit 1*p*.

The lower casing 1*b* houses therein: the supporting unit 60; the wiper unit (not shown); the two waste liquid trays 65; the sheet supply portion 1*e*; the paper sheet sensor 32; the pairs of feed rollers 22 and 23; two pairs of guide walls 29 that are positioned between the sheet supply portion 1*c* and the pair of feed rollers 23 along the sheet conveying direction; a lower roller 24 in the pair of feed rollers 24; a lower roller 25 in the pair of feed rollers 25; a lower roller 26 in the pair of feed rollers 26; and a lower guide wall 29 in the pair of guide walls 29 positioned between the pair of feed rollers 25 and the pair of feed rollers 26.

The upper casing 1*a* houses therein: the recording unit 9; the cartridge holding portion 51 and the cartridge 50 mounted in the cartridge holding portion 51; the control unit 1*p*; an upper roller 24 in the pair of feed rollers 24; an upper roller 25 in the pair of feed rollers 25; an upper roller 26 in the pair of feed rollers 26; an upper guide wall 29 in the pair of guide walls 29 that is positioned between the pair of feed rollers 25 and the pair of feed rollers 26; the pairs of feed rollers 27 and 28; and two pairs of guide walls 29 that are positioned between the pair of feed rollers 26 and the pair of feed rollers 28 along the sheet conveying direction. When the upper casing 1*a* is rotated from the proximity position to the separation position, all the components housed in the upper casing 1*a* move together with the upper casing 1*a*.

The control unit 1*p* is for controlling the operation of each portion in the printer 1.

The sheet supply portion 1*c* includes a sheet supply tray 20 and a sheet supply roller 21. The sheet supply tray 20 can be attached to and removed from the lower casing 1*b* in the sub-scanning direction. The sheet supply tray 20 is in a box shape that is open upward, and is able to store paper sheets P of a plurality of different sizes. The sheet supply roller 21 rotates under the control of the control unit 1*p*, and sends a top paper sheet P among those stored in the sheet supply tray 20.

The paper sheet P sent from the sheet supply portion 1*c* is first conveyed by the feed rollers 22 and 23 in succession along the pairs of guide walls 29 into between the recording unit 9 and the supporting unit 60. The supporting unit 60 is for supporting the paper sheet P while the feed rollers 24 are conveying the paper sheet P. The recording unit 9 is for ejecting liquid onto the paper sheet P supported on the supporting unit 60, thereby recording an image on the paper sheet P. After being recorded with an image by the recording unit 9, the paper sheet is further conveyed by the feed rollers 25-28 in succession along the remaining pairs of guide walls 29, and is finally discharged onto the sheet discharging portion 31.

The cartridge holding portion 51 is for holding the cartridge 50 in such a way that the cartridge 50 can be attached to and removed from the cartridge holding portion 51. The cartridge 50 accommodates therein pretreatment liquid and black ink (collectively referred to as "liquid," hereinafter) that is to be supplied to the heads 10. The pretreatment liquid is for preventing bleeding and strike-through of ink, and for improving color development and quick-drying characteristics of ink.

In the recording unit 9, the frame 3 supports the two heads 10. The frame 3 also supports the upper roller 24 in the pair of feed rollers 24.

The frame 3 is fixedly secured to the upper-casing frame 1*a*1. The heads 10 are fixedly secured to the frame 3. The upper roller 24 are rotatably supported by the frame 3.

The heads 10 include: a pre-coating head 10 for ejecting pretreatment liquid; and an ink-jet head 10 for ejecting black ink. The pre-coating head 10 and the ink-jet head 10 are arranged in this order in the sheet conveying direction from its upstream side toward a downstream side.

The heads 10 are of a line type, and are elongated in the main scanning direction. The outer shape of the heads 10 is substantially a rectangular parallelepiped. The heads 10 are mounted on the frame 3 such that the heads 10 are separate from each other in the sub-scanning direction. The heads 10 are oriented so that the liquid ejection surfaces 10*a* of the heads 10 are parallel to the horizontal plane and face vertically downwardly when the upper casing 1*a* is in the proximity position. Each liquid ejection surface 10*a* is formed with many ejection nozzles (ejection openings). An upper surface of each head 10 is provided with a joint. The joint is attached with a tube. Flow channels are formed inside each head 10. Liquid is supplied from the cartridge 50 to the heads 10, and flows through the flow channels, before reaching the ejection nozzles.

The heads 10 are positioned such that a distance between the liquid ejection surfaces 10*a* and the upper surface 1*au* of the upper casing 1*a* in the vertical direction is greater than the distance between the liquid ejection surfaces 10*a* and the lower surface of the upper casing 1*a* in the vertical direction. It is noted that the lower surface of the upper casing 1*a* is defined by a lower edge 1*ae* of the upper casing 1*a*. The liquid ejection surfaces 10*a* are at a lower position than the shaft 1*h* in the vertical direction when the upper casing 1*a* is in the proximity position.

The cartridge 50 is fluidly connected to the heads 10 via the cartridge holding portion 51, tubes (not shown), and pumps (not shown). Incidentally, the pumps are driven by the control unit 1*p* only when liquid is forcibly sent to the heads 10 (i.e. when a purge operation or the initial introduction of the liquids is carried out). At the time of image recording, a negative pressure occurs in the flow channels in the heads 10. Therefore, liquid in the cartridge 50 is automatically supplied to the heads 10.

The supporting unit 60 is disposed opposing the recording unit 9 in the vertical direction when the upper casing 1*a* is in the proximity position. The supporting unit 60 includes a frame 11. The frame 11 is fixedly secured to the lower-casing frame 1*b*1. The frame 11 supports two rotating members 64 such that the rotating members 64 are rotatable relative to the frame 11. The frame 11 also supports a lower feed roller 24 in the pair of feed rollers 24 such that the lower feed roller 24 is rotatable relative to the frame 11. The frame 11 is disposed in the lower casing 1*b* at such a location that the two rotating members 64 face the heads 10 when the upper casing 1*a* is in the proximate position.

Each rotating member 64 is in a rectangular parallelepiped shape. The rotating member 64 includes: a cylinder portion 63; a platen 61; and an opposing member 62. The cylinder portion 63 is in a circular cylindrical shape, with its axis extending in the main scanning direction. The platen 61 and the opposing member 62 are attached to the cylinder portion 63. More specifically, the platen 61 and the opposing member 62 are fixedly secured to the circumferential surface of the cylinder portion 63 such that the platen 61 and the opposing member 62 are disposed on the opposite sides relative to each other with respect to the cylinder portion 63. Thus, the cylinder portion 63 and the platen 61 and the opposing member 62 are united together into the rotating member 64 in the rectangular parallelepiped shape. The rotating member 64 is designed to rotate around the axis of the cylinder portion 63 under the control by the control unit 1*p*.

The platen 61 has a supporting surface 61*a* for supporting a paper sheet P thereon while facing the liquid ejection surface 10*a*. The material of the supporting surface 61*a* is selected and the supporting surface 61*a* is processed so that the supporting surface 61*a* can properly hold a paper sheet P thereon. For example, the platen 61 is made of resin. A low-adhesive silicone layer is formed on the supporting surface 61*a*. Or, a large number of ribs extending in the sub-scanning direction may be formed on the supporting surface 61*a*. This configuration can prevent a paper sheet P placed on the supporting surface 61*a* from floating.

The opposing member 62 is made of material that does not allow water to pass therethrough or that makes it difficult for water to pass therethrough. The opposing member 62 has an opposing surface 62*a* for facing the liquid ejection surface 10*a*. The opposing surface 62*a* is made smooth.

The rotating members 64 are supported in the frame 11 such that the supporting surface 61 and the opposing surface 62*a* can face the liquid ejection surfaces 10*a* in the vertical direction when the upper casing 1*a* is in the proximate position. The supporting surface 61 and the opposing surface 62*a* both are larger in size than the liquid ejection surface 10*a* in terms of the main scanning direction and the sub-scanning direction.

As the rotating members 64 rotate, the supporting unit 60 switches between a first state (See FIG. 2) and a second state. In the first state, the supporting surfaces 61*a* face the liquid ejection surfaces 10*a*, and the opposing surfaces 62*a* do not face the liquid ejection surfaces 10*a*. In the second state, the supporting surfaces 61*a* do not face the liquid ejection surfaces 10*a*, and the opposing surfaces 62*a* face the liquid ejection surfaces 10*a*. According to the present embodiment, the control unit 1*p* controls the driving of the rotating members 64 such that the supporting unit 60 is in the first state when liquid is ejected onto a paper sheet P to record an image on the paper sheet P, and is in the second state when a purge or wiping operation is carried out and the recording unit 9 is in a capping state.

The waste liquid trays 65 are disposed below the rotating members 64, and fluidly communicate with a waste liquid tank (not shown). When the purge or wiping operation is carried out, the waste liquid trays 65 receive liquid dropping from above and discharge the liquid to the waste liquid tank.

Figure 4:
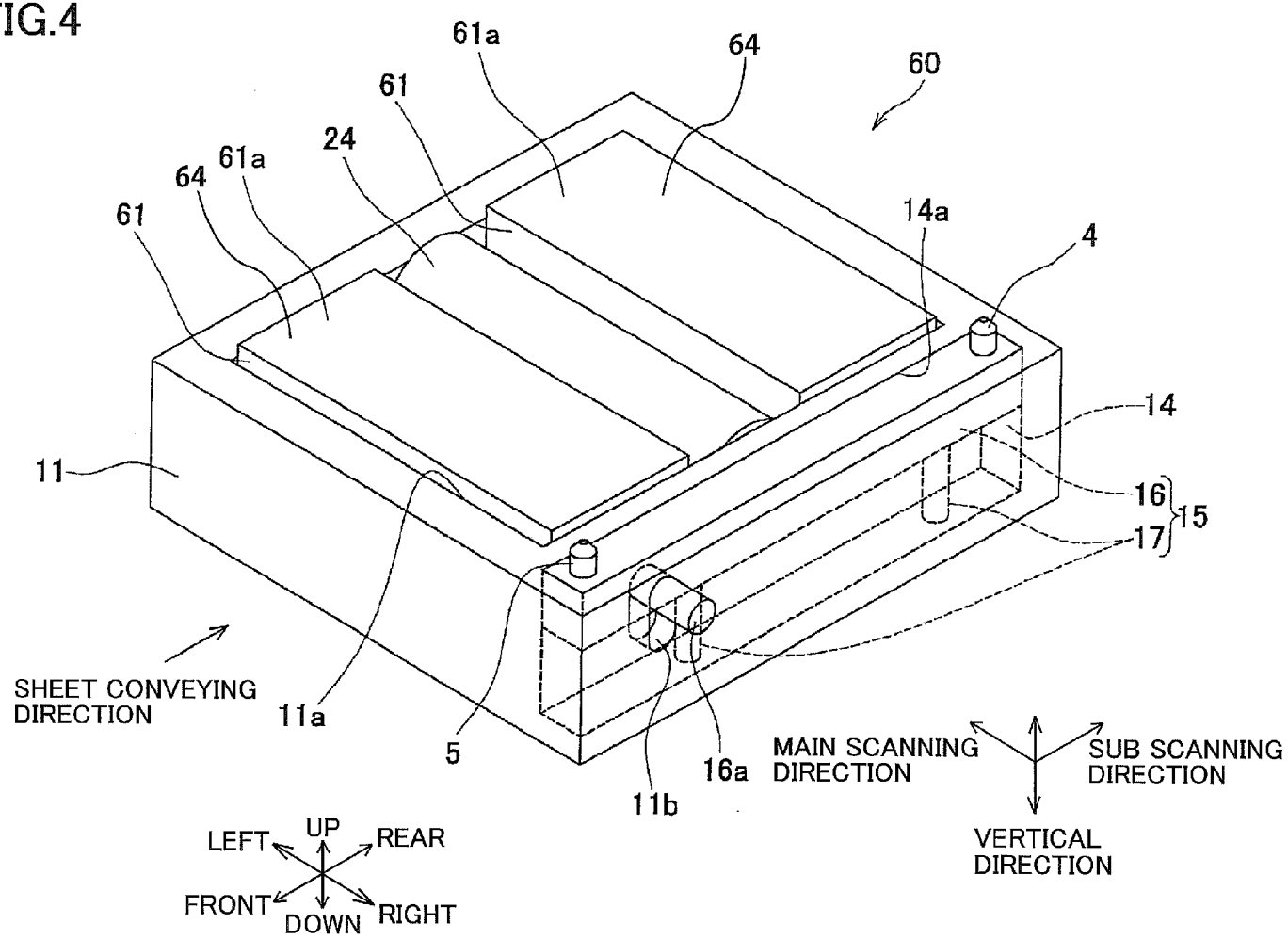
FIG. 4 is a perspective view schematically showing a support portion shown in FIG. 2.

Next will be described the frame 11 in greater details with reference to FIGS. 2, 3 and 4.

Figure 5A:
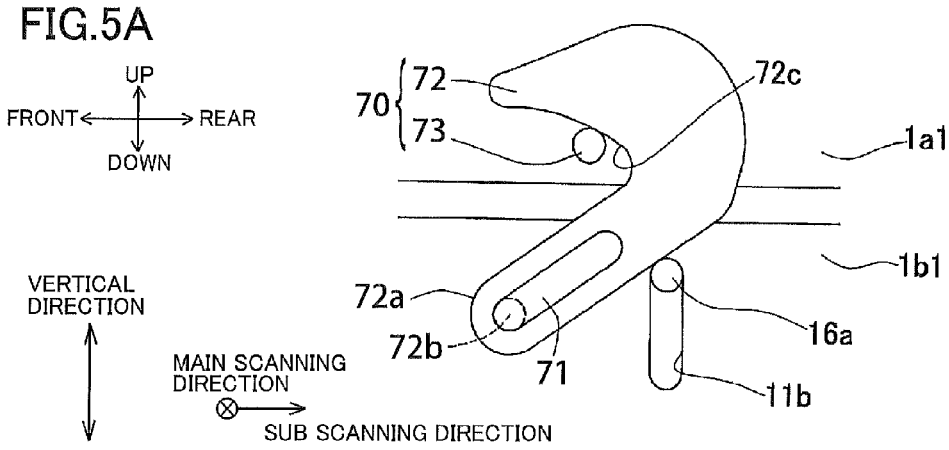

The frame 11 is fixedly secured to the upper-casing frame 1*a*1. As shown in FIG. 4, the frame 11 is formed into a rectangular frame shape, and includes a penetration portion 11*a* that penetrates the frame 11 in the vertical direction. Inside the penetration portion 11*a*, the frame 11 supports the two rotating members 64 and the lower feed roller 24 in the pair of feed rollers 24 such that the rotating members 64 and the lower roller 24 are rotatable relative to the frame 11. A concave portion 14 is formed on the frame 11. The concave portion 14 is opened on an upper surface of the frame 11 to form an opening 14*a*. The concave portion 14 is positioned at a right side end portion of the frame 11. The concave portion 14 is elongated in the sub scanning direction. An interlocking mechanism 15 is provided in the concave portion 14. The interlocking mechanism 15 is interlocked with the lock mechanism 70 (FIG. 5A).

The interlocking mechanism 15 includes a moving portion 16 and two springs 17. The moving portion 16 is capable of moving inside the concave portion 14 in the vertical direction relative to the frame 11. The two springs 17 are for urging the moving portion 16 upwardly. The two springs 17 are spaced away from each other in the sub scanning direction. According to the present embodiment, the springs 17 are coil springs 17. However, the springs 17 can be replaced with any elastic member other than coil springs as long as the elastic member can urge the moving portion 16 upward.

The moving portion 16 is in the shape of a rectangular parallelepiped, and substantially equal in planar size to the opening 14*a* of the concave portion 14. Guide pins 4 and 5 are formed on an upper surface of the moving portion 16. The guide pins 4 and 5 extend upward in the vertical direction (or in a direction perpendicular to the liquid ejection surfaces 10*a*). The guide pins 4 and 5 are disposed at a pair of opposite end portions of the moving portion 16 in the sub scanning direction (or around the corner portions of the frame 11). The guide pins 4 and 5 face guide holes 12 and 13 (described later) formed on the frame 3 when the upper casing 1*a* is in the proximate position. Each of the guide pins 4 and 5 is in the tapered columnar shape.

Figure 6A:
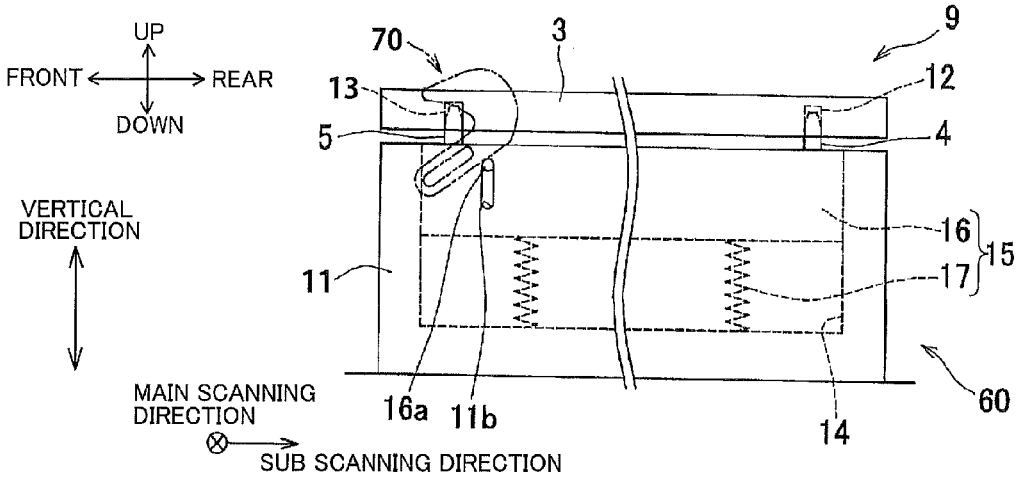

A long through-hole 11*b* is formed on the right side surface of the frame 11. The long through-hole 11*b* communicates with the inside of the concave portion 14. The long through-hole 11*b* is elongated in the vertical direction. A projecting portion 16*a* projects from a right side surface of the moving portion 16. The projecting portion 16*a* is positioned facing the long through-hole 11*b*, and is long enough to protrude from the long through-hole 11*b* outside the frame 11 in the main scanning direction. When the lock mechanism 70 operates, a tip end of the projecting portion 16*a* moves in the vertical direction, and the moving portion 16 moves together with the projecting portion 16*a* in the vertical direction. Accordingly, the guide pins 4 and 5 move in the vertical direction. More specifically, the moving portion 16 can move between an engagement position (FIG. 6A) where the guide pins 4 and 5 are in engagement with the guide holes 12 and 13 and a non-engagement position (FIG. 6B or 6C) where the guide pins 4 and 5 are out of engagement with the guide holes 12 and 13. That is, when the moving portion 16 is located at a position where the projecting portion 16*a* is in contact with an upper edge of the long through-hole 11*b* as shown in FIG. 6A, the moving portion 16 is placed at the engagement position. When the moving portion 16 is located between the position where the projecting portion 16*a* is at a middle portion of the long through-hole 11*b* (FIG. 6B) and the position where the projecting portion 16*a* is in contact with a lower edge of the long through-hole 11*b*, the moving portion 16 is placed at the non-engagement position.

Next will be described the frame 3 with reference to FIGS. 2, 3, and 6A and 6B.

Figure 6B:
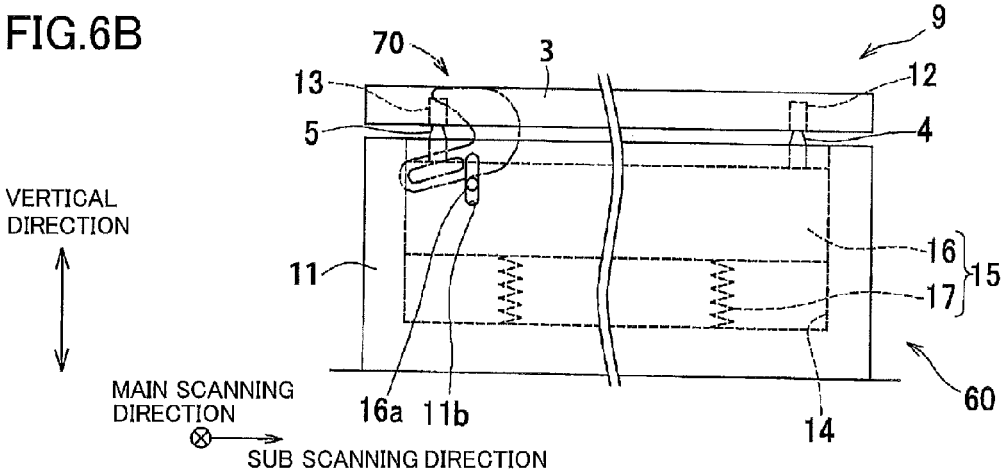
Figure 6C:
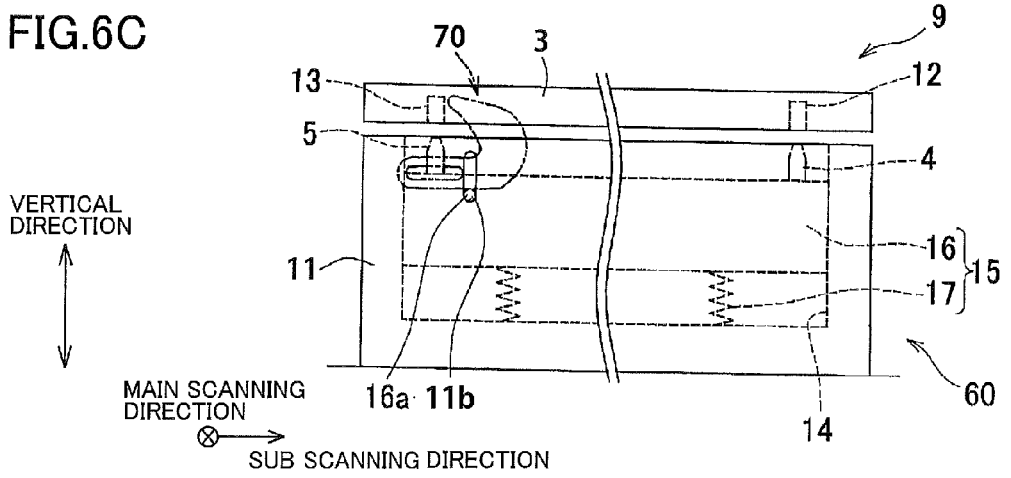

The frame 3 is formed into a rectangular frame shape, and supports the two heads 10 and the upper feed roller 24 in the pair of feed rollers 24. The frame 3 also supports rectangular-shaped frame members 40 such that the rectangular-shaped frame members 40 can move upward and downward relative to the frame 3. The two guide holes 12 and 13 are formed on a lower surface of the frame 3. The guide holes 12 and 13 are capable of being engaged with the guide pins 4 and 5, respectively. The guide pins 4 and 5 are inserted into the guide holes 12 and 13 when the upper casing 1*a* is in the proximity position as indicated by solid lines in FIG. 3. When the guide pins 4 and 5 are inserted into the guide holes 12 and 13, the guide pins 4 and 5 engage with the guide holes 12 and 13. The guide pins 4 and 5 and the guide holes 12 and 13 make up a positioning mechanism that positions the recording unit 9 and the supporting unit 60 relative to each other in the horizontal direction (main and sub scanning directions). That is, the guide pins 4 and 5 have such lengths that the guide pins 4 and 5 are inserted in and engage with the guide holes 12 and 13 when the upper casing 1*a* is in the proximity position and the lock mechanism 70 is in a restriction position (see FIG. 6A). The lengths of the guide pins 4 and 5 are such that the guide pins 4 and 5 become out of engagement with the guide holes 12 and 13 when the upper casing 1*a* is in the proximity position and the lock mechanism 70 is on the way from the restriction position to a release position (described later), that is, when the lock mechanism 70 is at a position as shown in FIG. 6B.

The two guide holes 12 and 13 are disposed side by side along the sub scanning direction. When the upper casing 1*a* is in the proximity position, the two guide holes 12 and 13 face the guide pins 4 and 5 in the vertical direction. The guide hole 12 is in a circular shape in planar view. The inner diameter of the guide hole 12 is substantially equal to, or slightly larger than, the outer diameter of the guide pin 4. A bowl-shaped tapered portion is formed around an opening of the guide hole 12, thereby making it easy for the guide pin 4 to be inserted into the guide hole 12.

Similarly to the guide hole 12, the guide hole 13 is in a circular shape in planar view. The inner diameter of the guide hole 13 is substantially equal to, or slightly larger than, the outer diameter of the guide pin 5. A bowl-shaped tapered portion is formed around an opening of the guide hole 13, thereby making it easy for the guide pin 5 to be inserted into the guide hole 13.

In the above-described manner, the guide holes 12 and 13 and the guide pins 4 and 5 engage with each other. As a result, the relative positions of the frames 3 and 11 are determined in the main scanning direction and the sub-scanning direction. That is, when the guide holes 12 and 13 and the guide pins 4 and 5 engage with each other, the frame 3 and/or the frame 11 slightly move in the horizontal direction, thereby determining the relative position between the frames 3 and 11 in the main scanning direction and the sub-scanning direction. Since the two sets of guide pins 4 and 5 and guide holes 12 and 13 are provided, the frames 3 and 11 are positioned relative to each other angularly along the horizontal plane. By thus positioning the frames 3 and 11 relative to each other in the horizontal plane, the positioning mechanism (the guide pins 4 and 5 and guide holes 12 and 13) can restrict the upper casing 1*a* from moving relative to the lower casing 1*b* in the horizontal direction when the upper casing 1*a* is in the proximity position.

Next will be described the configuration of the lock mechanism 70 with reference to FIGS. 1, 5A-5C, and 6A-6C.

As shown in FIG. 5A, the lock mechanism 70 includes a hook member 72 and a locking pin 73. The hook member 72 has a hook shape with a tip end thereof curved. The hook member 72 is connected at its base end portion 72*a* to the lower-casing frame 1*b*1 via a shaft 72*b*. The shaft 72*b* extends in the main scanning direction. The hook member 72 is supported so as to be rotatable around the shaft 72*b* relative to the lower casing 1*b*. The operation portion 71 protrudes from the right side surface of the hook member 72. The operation portion 71 protrudes outside the lower-casing decorative cover 1*b*2 through the opening 1*b*3 (see FIG. 1). When a user rotates the operation portion 71 in the direction indicated by an arrow in FIG. 1, the hook member 72 rotates from the restriction position (shown in FIG. 5A) to the release position (shown in FIG. 5B). The hook member 72 is disposed in a space between the lower-casing frame 1*b*1 and the lower-casing decorative cover 1*b*2. The locking pin 73 projects from the upper-casing frame 1*a*1, and is disposed in a space between the upper-casing frame 1*a*1 and the upper-casing decorative cover 1*a*2. As shown in FIG. 5A, the locking pin 73 is located at such a position that the locking pin 73 is in contact with a concave portion 72*c* of the hook member 72 and is locked by the hook member 72 when the hook member 72 is placed in the restriction position and the upper casing 1*a* is in the proximate position.

In the case where the upper casing 1*a* is in the proximity position, when the lock mechanism 70 is in the restriction position shown in FIG. 5A, the locking pin 73 is locked by the hook member 72 and restricts the upper casing 1*a* from moving. More specifically, the locking pin 73 is in contact with the concave portion 72*c* of the hook member 72, and the hook member 72 is located above the locking pin 73 in the vertical direction. So, the locking pin 73 cannot move upward in the vertical direction. Accordingly, the upper casing 1*a* that holds the locking pin 73 cannot move from the proximity position to the separation position.

In the case where the upper casing 1*a* is in the proximity position, when the lock mechanism 70 moves to the release position (FIG. 5B), lock of the locking pin 73 by the hook member 72 is released to allow the upper casing 1*a* to move from the proximity position to the separation position. More specifically, the locking pin 73 becomes out of contact with the concave portion 72*c* of the hook member 72, and the hook member 72 shifts from the position above the locking pin 73 in the vertical direction. So, the locking pin 73 becomes movable upward in the vertical direction. The upper casing 1*a* that holds the locking pin 73 becomes movable from the proximity position to the separation position.

Figure 5B:
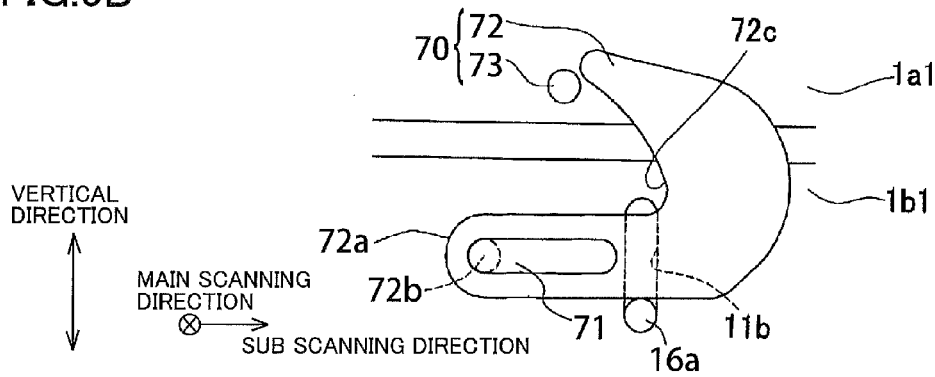
Figure 5C:
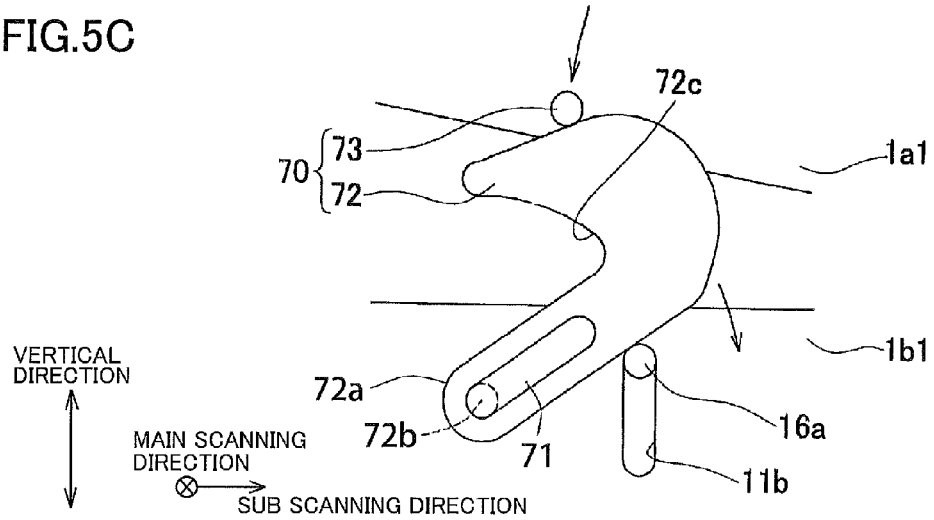

Incidentally, in the case where the upper casing 1*a* is not in the proximity position, even though the lock mechanism 70 is at the restriction position as shown in FIG. 5C, the locking pin 73 is not in contact with the concave portion 72*c* of the hook member 72, and therefore the upper casing 1*a* can freely rotate.

A lower surface of the hook member 72 is in contact with the projecting portion 16*a*. Accordingly, the hook member 72 is urged by the springs 17 upwardly, that is, toward the restriction position. So, the hook member 72 is always in contact with the projecting portion 16*a*. In other words, the projecting portion 16*a* and the moving portion 16 are interlocked with the hook member 72 so as to go up and down, thereby moving between the engagement position and the non-engagement position. Therefore, the guide pins 4 and 5 and the guide holes 12 and 13 change between the engagement state, in which the guide pins 4 and 5 are in engagement with the guide holes 12 and 13, and the non-engagement state, in which the guide pins 4 and 5 are out of engagement with the guide holes 12 and 13.

According to the above-described configuration, when the upper casing 1*a* is in the proximity position, a user operates the operation portion 71, thereby rotating the hook member 72 from the restriction position shown in FIG. 5A to the release position shown in FIG. 5B. As a result, the engagement of the hook member 72 with the locking pin 73 is released. That is, the restrictions on the rotation of the upper casing 1*a* are released, thereby allowing the upper casing 1*a* to move from the proximity position to the separation position. At this time, the interlocking mechanism 15 operates together with the lock mechanism 70. That is, as shown in FIG. 6A, when the hook member 72 is at the restriction position, the moving portion 16 is placed in the engagement position at which the guide pins 4 and 5 are in engagement with the guide holes 12 and 13. Then, as the hook member 72 rotates toward the release position, the projecting portion 16*a* (moving portion 16) moves downward. When the hook member 72 rotates to the position shown in FIG. 6B, the guide pins 4 and 5 come out of the guide holes 12 and 13. That is, just before the hook member 72 reaches the release position, the guide pins 4 and 5 come out of the guide holes 12 and 13. Thus, the moving portion 16 reaches the non-engagement position. After that, when the hook member 72 finally reaches the release position shown in FIG. 6C, the moving portion 16 stops moving downward. Also at this time, the moving portion 16 is placed at the non-engagement position.

In the above-described manner, the restriction by the lock mechanism 70 on the rotation of the upper casing 1*a* is released after the moving portion 16 has reached the non-engagement position. After the moving portion 16 has thus reached the non-engagement position, the upper casing 1*a* is rotated from the proximity position to the separation position. At this time, interference of the guide pins 4 and 5 with wall portions of the guide holes 12 and 13 does not occur because the engagement of the guide pins 4 and 5 with the guide holes 12 and 13 has already been released.

According to the present embodiment, when the upper casing la rotates from the proximity position to the separation position, the guide holes 12 and 13 move while drawing arc-shaped movement trajectories as shown in FIG. 3. That is, the movement region of the guide hole 12 is a region between arcs L3*a* and L4*a* indicated by two-dot chain lines in the diagram. The movement region of the guide hole 13 is a region between arcs L1*a* and L2*a* indicated by two-dot chain lines in the diagram. If the upper casing 1*a* were rotated from the proximity position to the separation position while the moving portion 16 is placed at the engagement position, the guide pins 4 and 5 will interfere with the wall portions of the guide holes 12 and 13 because the movement regions of the guide holes 12 and 13 overlap with the guide pins 4 and 5. However, according to the present embodiment, in order to rotate the upper casing 1*a* from the proximity position to the separation position, the user has to operate the lock mechanism 70 to the release position and brings the moving portion 16 into the non-engagement position. Therefore, the interference of the guide pins 4 and 5 with the wall portions of the guide holes 12 and 13 is prevented.

When the user separates his/her own hand away from the operation portion 71 in the state where the upper casing 1*a* is at in separation position, the urging force of the springs 17 moves the moving portion 16 upward and back to the engagement position. At this time, the projecting portion 16*a* pushes the hook member 72 back to the restriction position. That is, the hook member 72 automatically returns from the release position to the restriction position shown in FIG. 5C.

When the user rotates the upper casing 1*a* from the separation position back to the proximity position, as shown in FIG. 5C, the locking pin 73 comes in contact with the upper surface of the hook member 72. As the upper casing 1 a rotates to the proximity position, the locking pin 73 pushes the hook member 72. The hook member 72 rotates clockwise shown in the diagram. At this time, the hook member 72 rotates until the locking pin 73 goes beyond the tip end of the hook member 72 and the hook member 72 reaches the release position. Before the locking pin 73 goes beyond the tip end of the hook member 72 and the hook member 72 reaches the release position, the moving portion 16 reaches the non-engagement position. Therefore, also when the upper casing 1*a* moves back to the proximity position, the interference of the guide pins 4 and 5 with the wall portions of the guide holes 12 and 13 is prevented. After the locking pin 73 goes beyond the tip of the hook member 72, as the upper casing 1*a* approaches the proximity position, the hook member 72 returns to the restriction position. In this manner, when the upper casing 1*a* reaches the proximity position, the locking pin 73 is locked by the hook member 72. The lock mechanism 70 therefore restricts the rotation of the upper casing 1*a*.

Next will be described the cartridge holding portion 51 with reference to FIGS. 7 and 8. It is noted that in FIG. 8, showing of part in the upper casing 1*a* other than the cartridge holding portion 51 and the shaft 1*h* is omitted in order to facilitate understanding.

Figure 7:
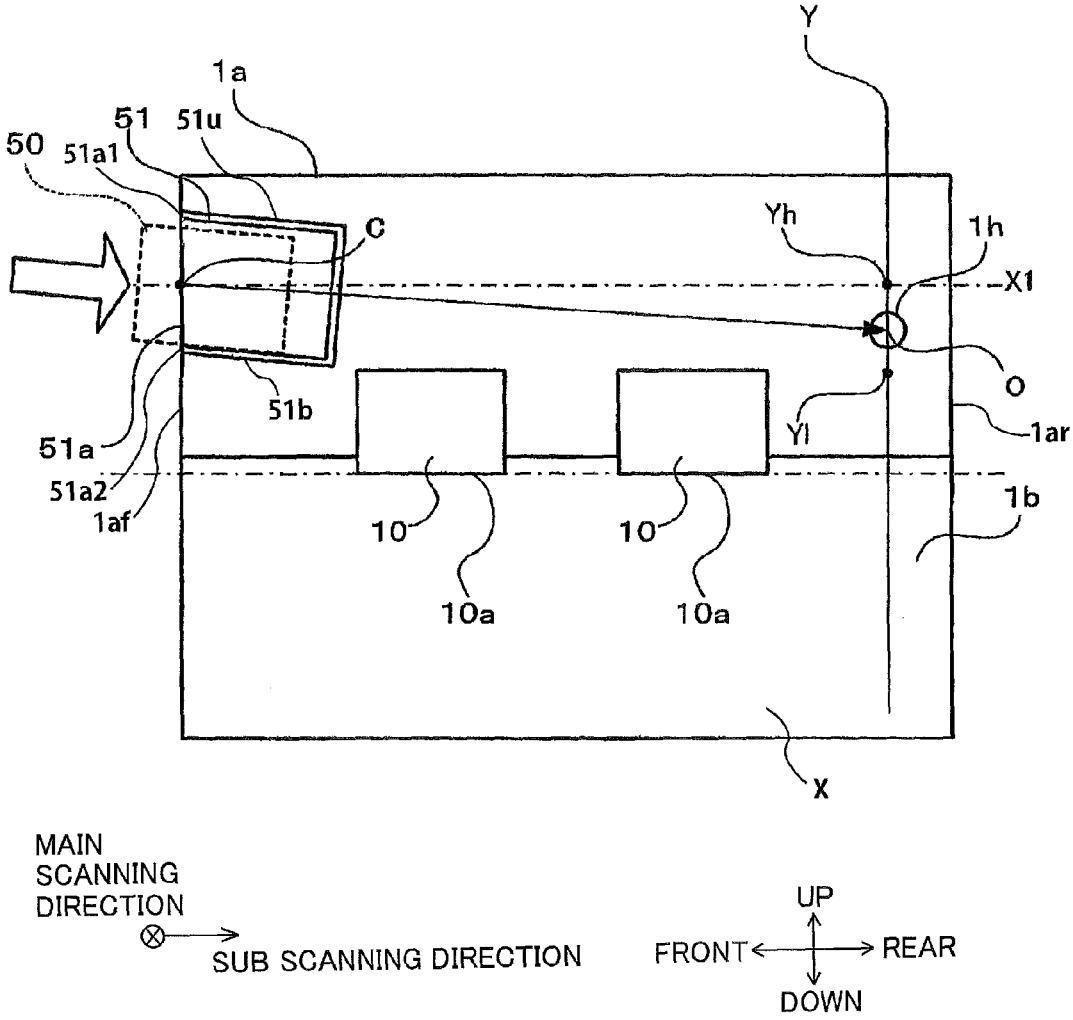
FIG. 7 is a side view schematically showing how a cartridge is inserted into a cartridge holding portion.
Figure 8:
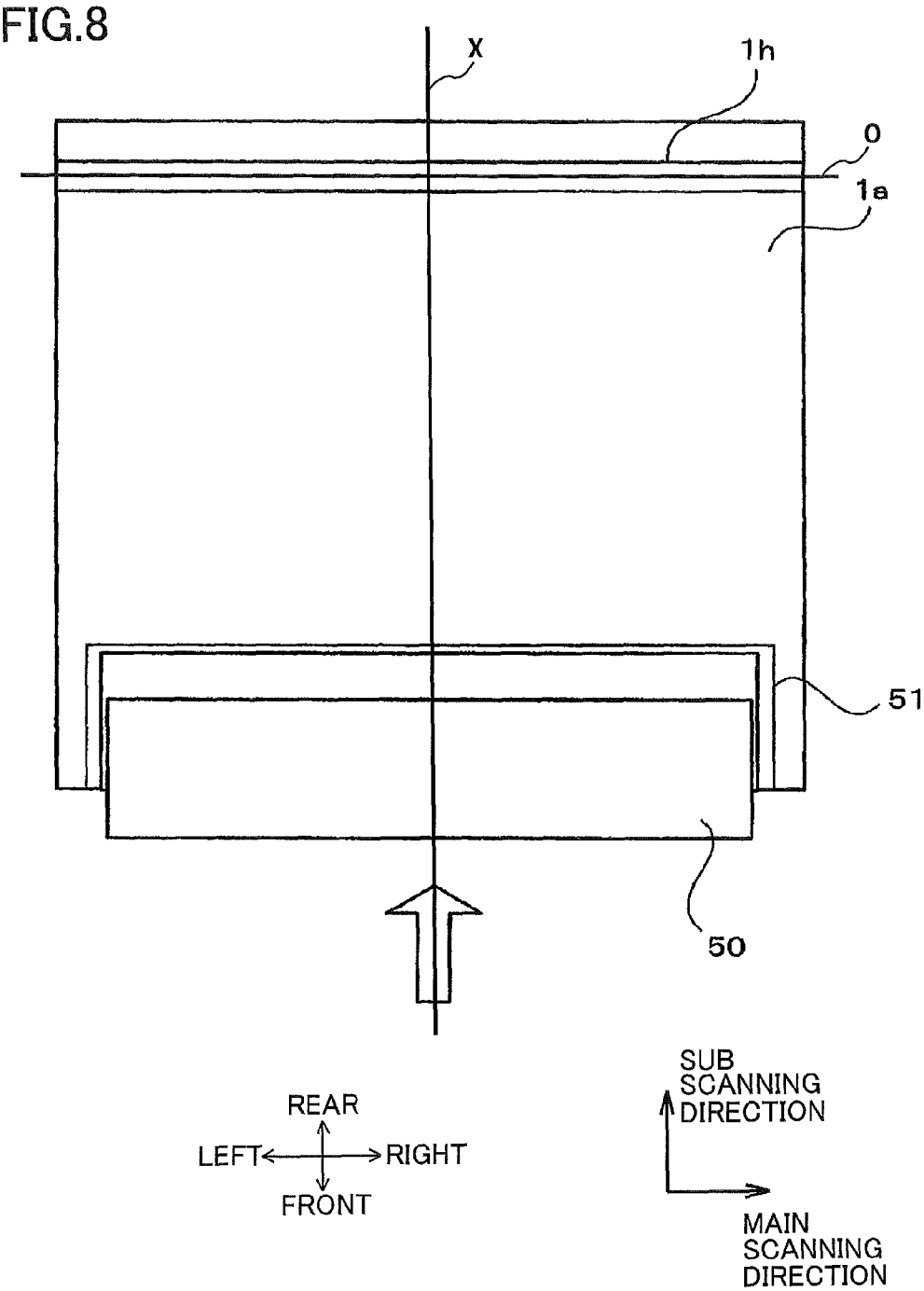
FIG. 8 is a plan view schematically showing how the cartridge is inserted into the cartridge holding portion.

As shown in FIGS. 7 and 8, the cartridge 50 and the cartridge holding portion 51 are elongated in an axial direction in which the axis o of the shaft 1*h* extends. The cartridge holding portion 51 is fixedly secured to the upper-casing frame 1*a*1. The cartridge holding portion 51 is placed adjacent to the front surface 1*af* of the upper casing 1*a*. It is noted that the front surface 1*af* and the rear surface 1*ar* of the upper casing 1 a extend in a direction intersecting with the liquid ejection surfaces 10*a* and in the axial direction in which the axis o of the shaft 1*h* extends. The front surface 1*af* is positioned further away from the axis o than the rear surface 1*ar* in terms of the front-rear direction, which is perpendicular to the axis o and which runs parallel to the liquid ejection surfaces 10*a*.

Moreover, the cartridge holding portion 51 is placed at a level higher than the heads 10 in terms of the vertical direction.

The cartridge holding portion 51 has a bottom wall 51*b*, on which the cartridge 50 slides when the cartridge 50 is inserted into the cartridge holding portion 51. The cartridge holding portion 51 further has an upper wall 51*u* opposing the bottom wall 51*b* in the vertical direction.

An insertion opening 51*a* is provided on the front surface 1*af* of the upper casing 1*a* to allow the cartridge 50 to be inserted into the cartridge holding portion 51. (It is noted that showing of the insertion opening 51*a* is omitted from FIGS. 1 and 2.) An upper edge 51*a*1 of the insertion opening 51*a* is defined by an intersection between the front surface 1 of of the upper casing 1*a* and the upper wall 51*u* of the cartridge holding portion 51. A lower edge 51*a*2 of the insertion opening 51*a* is defined by an intersection between the front surface 1*af* of the upper casing 1*a* and the bottom wall 51*b* of the cartridge holding portion 51.

The bottom wall 51*b* of the cartridge holding portion 51 extends in an insertion direction (indicated by arrows in FIGS. 7 and 8), in which the cartridge 50 moves when the cartridge 50 is inserted into the cartridge holding portion 51 via the insertion opening 51*a*.

When seen in the axial direction in which the axis o extends, a central point C is defined at the center in the insertion opening 51*a* in the vertical direction (direction perpendicular to the liquid ejection surfaces 10*a*). That is, a distance between the central point C and the upper edge 51*a*1 along the vertical direction is equal to a distance between the central point C and the lower edge 51*a*2 along the vertical direction. The central point C is positioned at a level higher than the axis o in the vertical direction.

When seen in the axial direction of the axis o, as shown in FIG. 7, the insertion direction is a direction in which the cartridge 50 takes the shortest distance toward the axis o from the central point C. So, the insertion direction is slanted downwardly toward the rear. That is, the insertion direction is slanted from the upper casing 1*a* side to the lower casing 1*b* side toward the rear.

As shown in FIG. 7, that is, when seen in the axial direction in which the axis o extends, an imaginary line X1, an imaginary plane Y, an upper reference point Yh and a lower reference point Y1 are defined as follows: The imaginary line X1 is defined as a line that passes through the central point C and runs parallel to the front-rear direction. The imaginary plane Y is defined as an imaginary plane that contains the axis o and that is perpendicular to a plane containing the liquid ejection surfaces 10*a*. The upper reference point Yh is defined as an intersection point between the imaginary line X1 and the imaginary plane Y. The lower reference point Y1 is defined as a point on the imaginary plane Y that is symmetrical with the upper reference point Yh with respect to the axis o.

In the present embodiment, when seen in the axial direction in which the axis o extends, that is, in the surface of the sheet of FIG. 7, the insertion direction is directed from the central point C to the axis o. More specifically, suppose that an imaginary plane X is defined as perpendicular to both of the axis o and the plane containing the liquid ejection surfaces 10*a*. That is, the imaginary plane X extends along the surface of the sheet of FIG. 7. The insertion direction is defined on the imaginary plane X as being directed from the central point C to the axis o.

It is noted that the insertion direction may not be directed to the axis o of the shaft 1*h*. The insertion direction can be any direction as long as the insertion direction is defined on the imaginary plane X as being directed from the central point C to a point that is on the imaginary plane Y and that is closer to the axis o than the upper reference point Yh and the lower reference point Y1.

Incidentally, in terms of the vertical direction, the shaft 1*h* (axis o) is positioned farther away from the lower casing 1*b* than are the liquid ejection surfaces 10*a* when the upper casing 1*a* is in the proximity position. That is, the shaft 1*h* (axis o) is positioned at a level higher than the liquid ejection surfaces 10*a* when the upper casing la is in the proximity position.

As described above, in the printer 1 of the present embodiment, the insertion direction of the cartridge 50 is tilted downward toward the rear, making it easy to insert the cartridge 50. Moreover, compared with the case where the insertion direction of the cartridge 50 were horizontal, the shearing force applied to the shaft 1*h* decreases, thereby preventing components disposed around the shaft 1*h* (which include a hinge, for example) from being damaged. Since the insertion opening 51*a* is provided on the front surface 1*af* of the upper casing 1*a*, a user can easily mount and remove the cartridge 50. Because the rotation moment arising from the shearing force that is generated when the cartridge 50 is inserted decreases, the upper casing 1*a* is unlikely to rotate, making it easy to insert the cartridge 50.

In particular, by directing the insertion direction of the cartridge 50 to the axis o of the shaft 1*h*, the shearing force applied to the shaft 1*h* can be minimized.

In terms of the vertical direction, the shaft 1*h* is positioned farther away from the lower casing 1*b* than are the liquid ejection surfaces 10*a*. Therefore, for example, compared with the case where the shaft 1*h* were positioned at the same height as the liquid ejection surfaces 10*a* in the vertical direction, the amount of shearing force that is applied to the shaft 1*h* when the cartridge 50 is inserted into the cartridge holding portion 51 can be made smaller if the angle formed between the insertion direction of the cartridge 50 and the horizontal direction is the same. As a result, the components around the shaft 1*h* (which include a hinge, for example) can be made smaller in size, and/or further improvements can be made in the durability of the components.

Alternatively, compared with the case where the shaft 1*h* were positioned at the same height as the liquid ejection surfaces 10*a*, a smaller amount of angle between the insertion direction of the cartridge 50 and the horizontal direction can apply the same amount of shearing force to the shaft 1*h*. As a result, the upper casing 1*a* can be made smaller in thickness, and therefore the printer 1 can be made smaller in height.

The cartridge 50 is elongated along the shaft 1*h*. Therefore, even if the cartridge 50 is tilted in terms of a direction perpendicular to the shaft 1*h*, the upper casing 1*a* can be made smaller in thickness.

The sheet discharging portion 31 is provided on the upper surface 1*au* of the upper casing 1*a* that is unlikely to rotate when the cartridge 50 is inserted into the upper casing 1*a*. Therefore, the paper sheets stacked in the sheet discharging portion 31 are unlikely to fall therefrom when the cartridge 50 are mounted.

When the upper casing 1*a* is in the proximity position, the locking pin 73 is locked by the hook member 72. In this manner, the lock mechanism 70 restricts the rotation of the upper casing 1*a*. Therefore, when the cartridge 50 is inserted into the upper casing 1*a*, the rotation of the upper casing 1*a* is prevented without fail. The damage to the shaft 1*h* is suppressed.

The frame 3 is fixedly secured to the upper casing 1*a*. The frame 11 is fixedly secured to the lower casing 1*b*. The lock mechanism 70 restricts the relative movement between the frames 3 and 11 in the main and sub scanning directions, thereby restricting the relative movement between the upper and lower casings 1*a* and 1*b* in the main and sub scanning directions. So, when a cartridge 50 is inserted into the cartridge holding portion 51, the upper casing 1*a* will not move in the insertion direction relative to the lower casing 1*b*.

<Modification>

Figure 9:
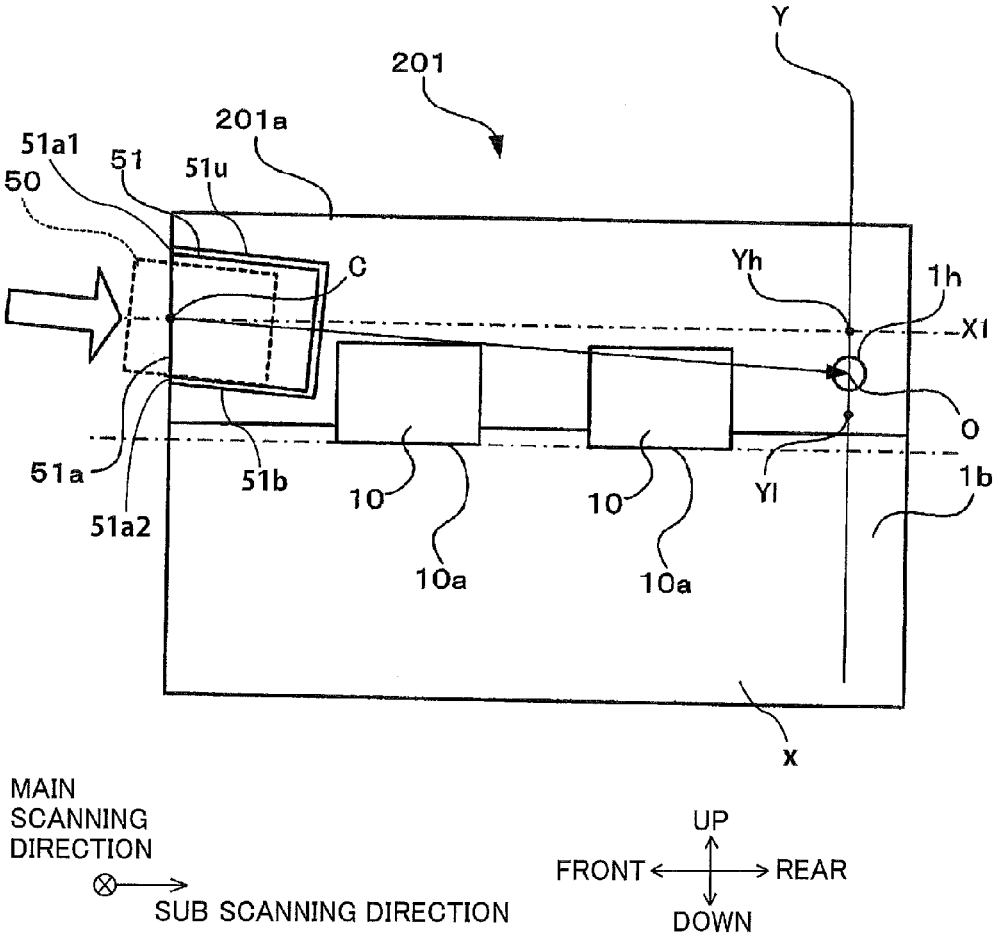
FIG. 9 is a side view schematically showing how a cartridge is inserted into a cartridge holding portion according to a modification.

A modification of the present embodiment will be described with reference to FIG. 9. In the present modification, as shown in FIG. 9, when seen from a direction running along the axis o, the heads 10 and the insertion opening 51*a* are disposed to partially overlap with each other in terms of the vertical direction. As a result, the upper casing 201*a* can be made smaller in thickness, and the printer 201 overall can be made smaller in height.

While the invention has been described in detail with reference to the embodiment thereof, it would be apparent to those skilled in the art that various changes and modifications may be made therein without departing from the spirit of the invention.

For example, according to the above embodiment, in terms of the vertical direction, the shaft 1*h* is farther away from the lower casing 1*b* than are the liquid ejection surfaces 10*a*. However, the distance between the shaft 1*h* and the lower casing 1*b* may be equal to the distance between the liquid ejection surfaces 10*a* and the lower casing 1*b*; or the shaft 1*h* may be disposed closer to the lower casing 1*b* than are the liquid ejection surfaces 10*a*.

According to the above embodiment, the cartridge 50 is elongated along the shaft 1*h*. However, the cartridge may be formed into any shape. For example, the cartridge 50 may be elongated in a direction perpendicular to the shaft 1*h*.

According to the above-described embodiment, the sheet discharging portion 31 is provided on the upper surface 1*au* of the upper casing 1*a*. However, the sheet discharging portion may be placed at any location. For example, the sheet discharging portion may be on the front or rear surface of the upper casing.

According to the above-described embodiment, the printer 1 includes the lock mechanism 70. However, the printer 1 may not include the lock mechanism 70.

According to the above embodiment, the cartridge 50 is connected directly to the heads 10 via tubes. However, sub-tanks that temporarily store ink and pretreatment liquid may be provided between the cartridge 50 and the heads 10. The ink and pretreatment liquid is supplied from the cartridge 50 to the heads 10 via the sub-tanks.

The present invention can be applied to printers of a line type and of a serial type. Moreover, the present invention is not limited to printers. The present invention can be applied to facsimile machines and copy machines. The present invention can also be applied to a recording device that records by discharging any liquid other than ink. The present invention is not limited to an ink-jet type. For example, the present invention can also be applied to recording devices of a laser type and of a thermal type. A recording medium is not limited to the paper sheet P, but various recordable media can be used.

The supporting unit 60 and the pair of feed rollers 24 may be replaced with a belt conveying mechanism. The belt conveying mechanism is retained by the lower casing 1*b*. In the belt conveying mechanism, an endless belt is stretched between at least two rollers that are arranged in the sheet conveying direction as being separate away from one another. The upper surface of the belt moves in the sheet conveying direction as the rollers are driven to rotate. The belt therefore conveys the sheet of paper P in the sheet conveying direction, while supporting the sheet of paper P on its upper surface. Thus, the belt serves to convey the sheet of paper P while confronting the heads 10 and supporting the sheet of paper P thereon.

What is claimed is:

1. A liquid ejection apparatus comprising:

a supporting portion that is configured to support a recording medium;

a liquid ejection head that has an ejection surface formed with ejection openings, through which the liquid ejection head ejects liquid, the liquid ejection head being configured to record an image on a recording medium supported by the supporting portion by ejecting liquid from the ejection openings;

a first casing that holds the supporting portion; and a second casing that holds the liquid ejection head and a cartridge holding portion, the cartridge holding portion being configured to hold a liquid cartridge, the liquid cartridge being detachably mountable in the cartridge holding portion, the cartridge holding portion having an upper wall and a lower wall opposite to the upper wall, the second casing being connected to the first casing so as to be rotatable relative to the first casing about a prescribed axis, the second casing being configured to move between a first position and a second position by rotating relative to the first casing, the liquid ejection head being located adjacent to the first casing when the second casing is in the first position, the liquid ejection head being further apart from the first casing when the second casing is in the second position than when the second casing is in the first position, the ejection surface opposing the supporting portion when the second casing is in the first position, a first direction being defined as being perpendicular to a direction of the axis and being parallel with the ejection surface of the liquid ejection head, the second casing having first and second external surfaces opposing each other, the first and second external surfaces extending in a direction intersecting with the ejection surface and in an axial direction in which the axis extends, the first external surface being further away from the axis in the first direction than the second external surface, the first external surface having an insertion opening through which a liquid cartridge is inserted into the cartridge holding portion, the insertion opening being defined by an upper edge and a lower edge, the upper edge being an intersection between the first external surface and the upper wall of the cartridge holding portion, the lower edge being an intersection between the first external surface and the lower wall of the cartridge holding portion, a reference imaginary plane being defined as an imaginary plane on which the axis extends and which is perpendicular to the ejection surface, wherein when seen in the axial direction, a central point is defined as a central point in the insertion opening in a direction perpendicular to the ejection surface, a distance between the central point and the upper edge of the insertion opening in the direction perpendicular to the ejection surface being equal to a distance between the central point and the lower edge of the insertion opening in the direction perpendicular to the ejection surface, an imaginary line is defined as an imaginary line that passes through the central point and extends parallel with the first direction, an upper reference point is defined as an intersection point where the imaginary line intersects with the reference imaginary plane, a lower reference point is defined as a point that is on the reference imaginary plane and that is symmetrical with the upper reference point with reference to the axis, and the lower wall of the cartridge holding portion extends in an insertion direction, along which the cartridge holding portion enables the liquid cartridge to move when the liquid cartridge is inserted into the cartridge holding portion, the insertion direction being directed from the central point toward a point that is on the reference imaginary plane and that is closer to the axis than the upper and lower reference points.

2. The liquid ejection apparatus as claimed in claim 1, wherein the axis is positioned further away from the first casing than the ejection surface is, with respect to the direction perpendicular to the ejection surface.

3. The liquid ejection apparatus as claimed in claim 1, wherein when seen in the axial direction, the insertion direction is directed from the central point toward the axis.

4. The liquid ejection apparatus as claimed in claim 1, wherein the liquid cartridge and the cartridge holding portion are elongated in the axial direction.

5. The liquid ejection apparatus as claimed in claim 4, wherein the liquid ejection head and the insertion opening are disposed so as to at least partially overlap with each other in a direction perpendicular to the ejection surface when seen in the axial direction.

6. The liquid ejection apparatus as claimed in claim 1, wherein the second casing has a third external surface that is furthest away from the ejection surface among those external surfaces that extend in a direction intersecting with the first and second external surfaces, the second casing having a discharge portion on the third external surface, the discharge portion being configured to receive a stack of sheets of the recording medium that has been recorded with images by the liquid ejection head.

7. The liquid ejection apparatus as claimed in claim 1, further comprising a restriction mechanism having an engagement pin and an engagement member, wherein the engagement pin is configured to be engaged with the engagement member when the second casing is in the first position, thereby restricting the second casing from rotating relative to the first casing when the second casing is in the first position and restricting the second casing from moving relative to the first casing in the insertion direction when the second casing is in the first position.

8. The liquid ejection apparatus as claimed in claim 6, wherein the second casing has an upper surface that is further away from the ejection surface than a lower surface that is defined by a lower edge of the second casing, the discharge portion being provided on the upper surface.

9. The liquid ejection apparatus as claimed in claim 1, wherein the second casing has a discharge portion on its upper surface, the discharge portion being configured to receive a stack of sheets of the recording medium that has been recorded with images by the liquid ejection head.

* * * * *